United States Patent [19]

Benn

[11] Patent Number: 4,964,261

[45] Date of Patent: Oct. 23, 1990

[54] BAG FILLING METHOD AND APPARATUS FOR PREPARING PHARMACEUTICAL STERILE SOLUTIONS

[76] Inventor: James A. Benn, 31 Fairmount Ave., Somerville, Mass. 02144

[21] Appl. No.: 301,506

[22] Filed: Jan. 24, 1989

[51] Int. Cl.[5] ..... B65B 3/17; B65B 3/16; B65B 3/06

[52] U.S. Cl. ..... 53/469; 53/479; 383/37; 383/101; 383/904

[58] Field of Search ..... 53/450, 459, 469, 479, 53/548, 567, 576, 570; 383/904, 101, 37

[56] References Cited

U.S. PATENT DOCUMENTS

| | | | |
|---|---|---|---|
| 2,530,400 | 11/1950 | Rado | 53/469 |
| 2,802,324 | 8/1957 | Rado | 53/567 |
| 2,870,583 | 1/1959 | Flax | 53/469 |
| 2,958,169 | 11/1960 | Flax | 53/469 |
| 3,016,284 | 1/1962 | Trexler | 383/904 X |
| 3,566,930 | 3/1971 | Kirschner . | |
| 3,813,845 | 6/1974 | Weikert | 53/469 |
| 3,922,835 | 12/1975 | Reil . | |
| 3,941,306 | 3/1976 | Weikert | 383/37 |
| 4,021,283 | 5/1977 | Weikert | 53/469 X |
| 4,199,915 | 4/1980 | Levine | 53/469 X |
| 4,332,122 | 6/1982 | Williams . | |
| 4,372,100 | 2/1983 | Miller et al. | 53/469 X |
| 4,417,607 | 11/1983 | Scholle et al. . | |
| 4,452,030 | 6/1984 | Inada . | |
| 4,524,563 | 6/1985 | Sassi . | |
| 4,610,790 | 9/1986 | Reti et al. . | |
| 4,694,959 | 9/1987 | Ausnit et al. | 383/37 X |
| 4,754,786 | 7/1988 | Roberts . | |
| 4,856,261 | 8/1989 | Hackett et al. | 53/469 |

FOREIGN PATENT DOCUMENTS

| | | | |
|---|---|---|---|
| 1027124 | 3/1958 | Fed. Rep. of Germany | 53/469 |
| 95878 | 11/1960 | Netherlands | 53/469 |
| 353877 | 12/1972 | U.S.S.R. | 53/469 |

*Primary Examiner*—Horace M. Culver
*Attorney, Agent, or Firm*—Richard P. Crowley

[57] ABSTRACT

A bag filling method and apparatus for preparing pharmaceutical steril solutions in a plurality of sterile flexible bags in a non-sterile environment, which method and apparatus comprise providing a pre-sterilized tubular bag having a single inlet, introducing a solution through a sterilizing filter and introducing the sterile solution into the inlet of the tubular bag and sealing defined sections of the tubular bag after filling to a defined volume of the sterile solution to form a plurality of separate, flexible, sterile bags thereby providing a rapid, inexpensive, automated method and apparatus to prepare sterile solutions in bags.

21 Claims, 5 Drawing Sheets

BAG FILLING METHOD AND APPARATUS FOR PREPARING PHARMACEUTICAL STERILE SOLUTIONS

BACKGROUND OF THE INVENTION

It is desirable to provide a method and apparatus for packaging sterile solutions in pre-sterilized flexible bags to produce low cost sterile bags of solution in a non-sterile field environment.

Generally, packaging machinery produces bags of solutions through filling preformed empty bags through an opening to each bag, and then sealing the opening to produce a sealed bag of solution. Sterile bags of solution are often made through use of pre-sterilized bags, where the packaging machinery pierces the bag to be filed in a sterile manner, possibly in a sterile atmosphere, to fill and seal the bag with sterile solution while maintaining sterility of the solution and all internal bag surfaces. This method of making a bag of sterile solution requires use of a connecting methodology between bag set and filling machine that maintains sterility of the fluid filling the bag and the interior of the bag set. For many purposes, this connecting methodology is not reliable enough to ensure sterility of the bags produced to a high enough level. For example, bags of intravenous solutions for human use cannot be made this way because of the risk of contamination.

U.S. Pat. No. 4,610,790, issued September 1986, hereby incorporated by reference, discloses a method and apparatus to ensure sterile filling of bags to a high enough level that the bags will be safe for containing intravenous fluids for human use. Individual bags of sterile solution are produced through using a bag set consisting of 18 individual, flexible vinyl bags attached by means of tubing to a manifold containing 18 valves in turn attached to a sterilizing filter, all pre-sterilized after assembly into a bag set at the factory where the bag set is assembled. The sterilizing filter on the inlet to the bag set protects the internal volumes of the bags from contamination.

Individual sterile bags are produced in a non-sterile field environment by filling each bag with solution through opening a single valve in the manifold, and feeding solution through the sterilizing filter to the bag connected via the manifold. Tubes leading to the filled bags are then sealed and cut to free the individual filled sterile bags from the manifold.

This method of producing bags of fluid is inadequate mainly because the cost of the empty bag set is too expensive to make the cost of filled bags competitive with other methods of acquiring sterile bags of intravenous solution. The high cost of bag manufacture is due to the many tubes and connections that must be incorporated during manufacture of the bags. Also, the configuration of the bag set does not lend itself to being easily handled either manually or automatically.

It is therefore desirable to provide a new bag set design, method and apparatus that dramatically reduces the cost and complexity of manufacture of the bag set, yet allows these bags to be filled to make sterile bags of solution easily and automatically in the field.

SUMMARY OF THE INVENTION

The invention relates to a bag set design, method and apparatus for preparing bags of sterile solution in a non-sterile environment.

The invention provides for a bag set design and a method and apparatus for the use of the bag set in preparing small, flexible bags filled with a defined volume of a pharmaceutical sterile solution, such as sterile water and sterile aqueous solutions, in a rapid, simple, automated and inexpensive manner.

The bag set is essentially a long, tubular, thermoplastic bag element, closed at one end, with a fluid entry port on the other end connected by a single fill tube to a sterilizing filter, all sterilized after assembly During storage, transport and use, the sterilizing filter protects sterility of the interior of the bag. This single bag is used to make a plurality of smaller sterile bags of solution in the field through filling the single large sterile bag through the sterilizing filter, then sealing off sections of the bag to form smaller sterile bags from the single large bag.

The method of the invention comprises providing a pre-sterilized flexible tubular bag set having a single inlet for the introduction of a solution to be packaged into small bags, the bag set typically any one of a thermoplastic polymers, such as a heat-sealable, transparent, vinyl polymer. The method includes introducing the solution through a sterilizing filter into the single inlet of the bag set in a defined volume or weight, and thereafter sealing defined sections of the tubular bag set, typically by transverse sections, such as by the use of heat bars, radio frequency energy or ultrasonic energy to form small, flexible, sterile bags of the sterile solution. The sterilizing filter may comprise any filter, but typically includes microporous filters having a pore size of 0.50 microns or less. This method is unique, can be easily automated and is inexpensive and permits a high level of confidence in the sterility of the resulting bags of sterile solution required in pharmaceutical operations.

The bag set may be stored on a reel or other compact form for feeding to a filling station where the sterile solution is introduced. The filling operation may employ a weigh pan or a flow meter to meter a defined volume or weight of the sterile solution into the bag set prior to sealing the bag set to form the smaller bag. A sterile, sealed exit port may be inserted into the smaller bag and a bag hanging element added for ease in use of the bag.

The apparatus of the invention comprises a source of a tubular bag set to be filled with a sterile solution, such as in a continuous web form, the bag set having an inlet for the introduction of the sterile solution. The apparatus includes typically a sterilizing filter to provide a sterile solution into the bag set inlet and a filling station and a sealing station for sequentially filling and sealing and means to advance the bag set from the source through the filling and sealing stations to provide smaller, sterile bags.

In one packaging apparatus, solution to be packaged is introduced from the source through a sterilizing filter into only the bag portion that is removed from the source, e.g. the reel, which portion is pinched off to form a smaller bag, but leaves behind a tube that is still connected to the inlet of the bag set on the reel or bag set source. Another packaging apparatus and technique comprise initially only partial filling of the bag set while it is still mounted on the bag set reel or bag set source and only wholly filling the portion of the bag set after removal from the reel or source after which the filled portion is then sealed. This apparatus and technique generally requires the use of a spacer material for allow partial expansion of the bag set portion at its source to permit flow of the sterile solution to the bag set. The apparatus and method includes the sequential filling and sealing of defined sections of the bag set to provide smaller bags of pharmaceutically sterile solutions.

The invention comprises an apparatus and method that provide for inexpensive and automated filling of many bags. In prior art techniques, the majority of manufacturing cost is added by the sterilizing filter and assembly of complicated manifolds. Additionally, these complicated manifolds can only be used manually, and even then with great difficulty. The invention comprises an apparatus and a method to make many bags (more than, say, 10 and up to, say, 100) with a very simple bag arrangement and where a single sterilizing filter can be used to fill many bags. Additionally, the invention gives the capability of assuring a very high probability that each bag filled is sterile. The sterilizing filters can be tested at the facility where they were made to assure that they are capable of sterilizing to a high probability level. These can then be assembled into the bag set, and the assembly sterilized at the manufacturing facility, where quality assurance procedures can be used to show that sterilization was effective for all bags. When the system is used in the field or hospital pharmacy to make bags, the sterilizing filter again can be easily tested through the "bubble test" to determine that the sterilizing filter was actually performing the sterilizing function during the bag fill sequence. In combination, all these quality assurance steps can give the user in the pharmacy the assurance that less than one bag in a million will be not sterile. This is the same level of assurance the FDA now requires for all medical solutions.

The invention will be described for the purpose of illustration only in connection with certain embodiments to be described; however, it is recognized that those persons skilled in the art may make various changes, additions, modifications and improvements in the illustrated embodiments, all falling within the spirit and scope of the invention.

BRIEF DESCRIPTION OF THE EMBODIMENTS

Figure 1:
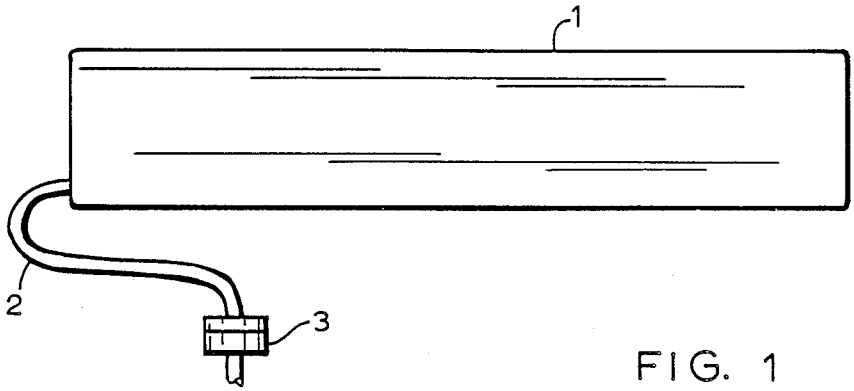
FIG. 1 is an illustrative top plan view of a bag set used in the invention.

FIG. 1 shows the basic low cost bag set design of the invention. The set is essentially one large bag 1 attached to a fill tube 2, which is in turn attached to a sterilizing filter 3. This large bag 1 can serve the dual purpose of a web that can be automatically fed into a packaging machine, and as bag feed stock which is filled with solution and segmented into individual bags in the packaging machine. This bag set configuration 1 can be made of a tube of vinyl sealed at both ends, or can be made of two sheets of vinyl sealed at all edges. The interior of the vinyl material can be made buff or textured to prevent sticking of the two sides together during storage. The whole bag 1, fill 2 and filter 3 can be sterilized at the factory and remain sterile while stored and filled in the field.

Figure 2:
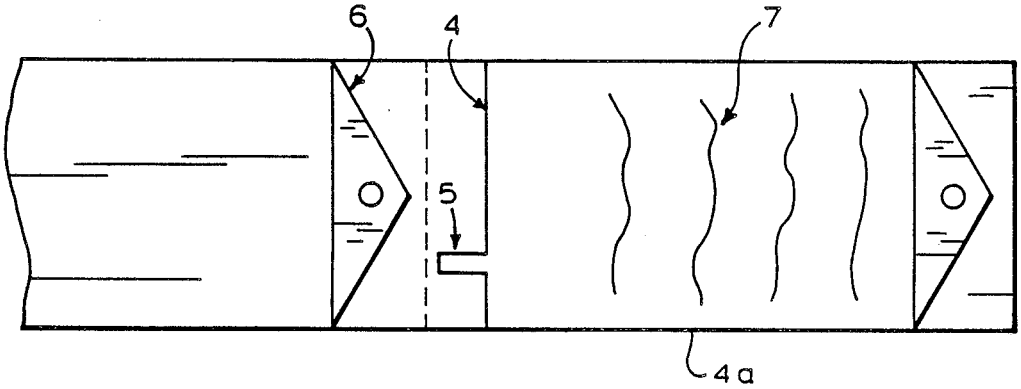
FIG. 2 is an illustrative, enlarged top plan view of a full single bag formed from the bag set of FIG. 1.

FIG. 2 shows how the single, large bag 1 can be formed into smaller bags by means of heat or radio frequency (RF or ultrasonics) sealing. After the sterile bag 1 is filled with sterile solution, seals 4 are made in the large bag to made individual bags **4*a*, bag hanger provision 6 and spike entry port 5. Bag labeling 7** can be done at the factory or in the field by a bag packaging machine.

Figure 3:
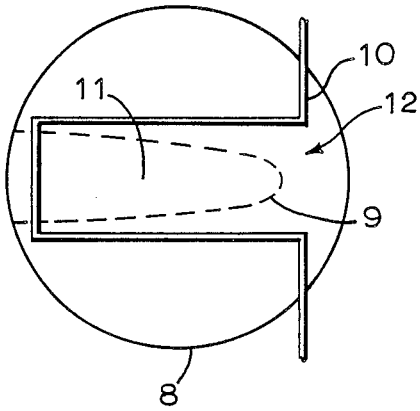
FIG. 3 is an enlarged, fragmentary, illustrative view of the exit port of the bag of FIG. 2.

FIG. 3 shows a close-up of a fluid exit port for the smaller bags **4*a* that can be made in the field by an RF or heat sealer that melts the vinyl bag material together. Vinyl patch 8 is attached to the outside of the vinyl bag 4*a* during assembly at the factory. A weakened area 9 is present in the patch to allow peel-back of that area. During the heat seal process in the field, seal line 10 is formed. This produces a fluid exit port wherein the flap 9 can be Peeled back, exposing a sterile surface 11 to be punctured with a standard intravenous solution spike set and a neck 12 through which the spike set enters the bag and which holds the spike set in place as the bag 4*a*** is drained through the set.

Figure 4:
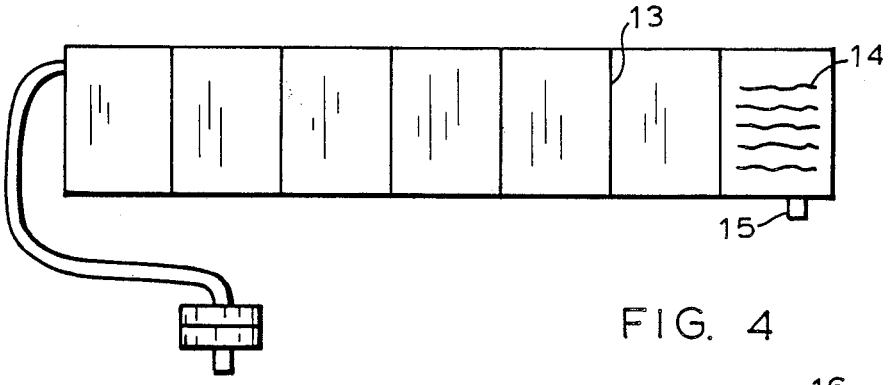
FIG. 4 is an illustrative top plan view of another bag set used in the invention.
Figure 5:
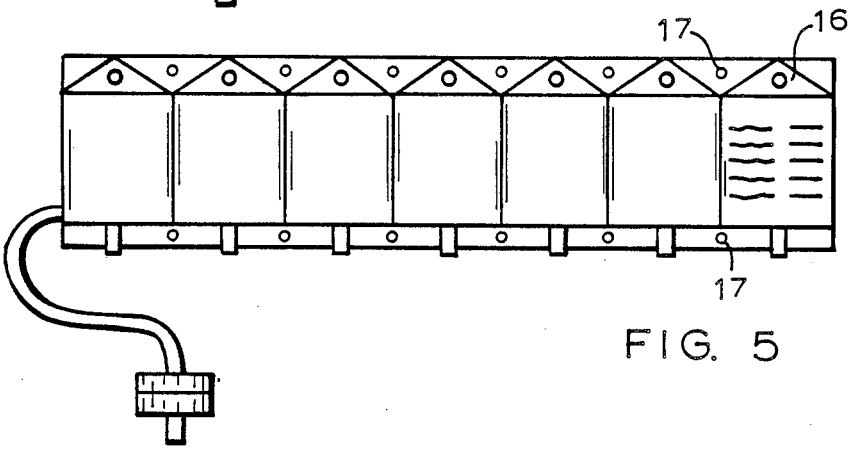
FIG. 5 is an illustrative top plan view of a plurality of single bags formed from the bag set of FIG. 4.

FIGS. 4 and 5 show bag sets that are more expensive to fabricate than bag 1, but are easier to fill and handle in the field. In FIG. 4 is shown partial bag partitions 13, bag labeling 14 and spike port 15 incorporated into the bag set in the factory. FIG. 5 shows these features in addition to bag hanging provision 16 and holes providing for automated machine indexing 17 by a bag packaging machine incorporated into the bag set.

Figure 6:
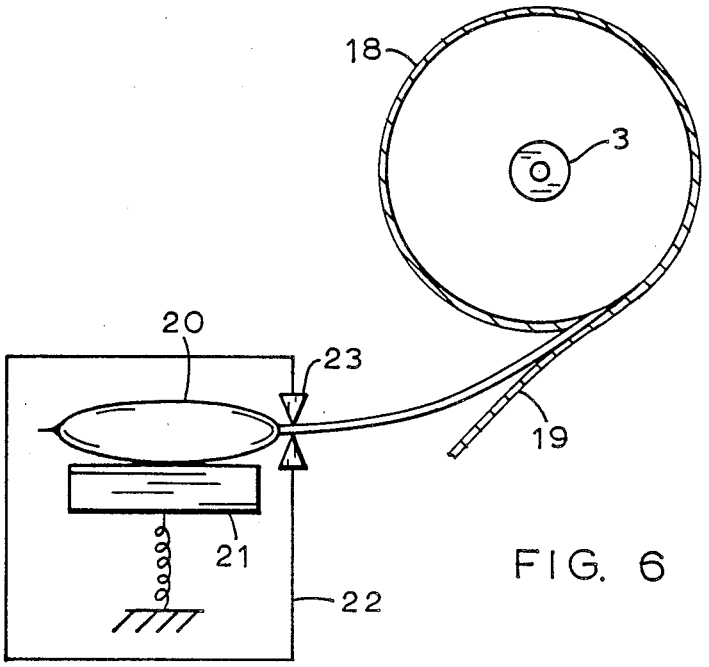
FIG. 6 is a schematic, illustrative side view of a packaging apparatus used to fill the bag sets of FIG. 1.

FIG. 6 shows packaging equipment that can be used to fill the bags described. A reel 18 holds the empty bag set wrapped on it for storage during the filling operation. The sterilizing filter 3 is held at the center of the reel and provides entry for fluid into the bag set. The bag set is wrapped with spacers 19 to allow the set to expand enough to pass fluid from the entry port to the bag being filled 20. Bag 20 is positioned on a weight scale 21 or other fluid metering device during filling to measure and meter volume into the bag being filled. Chamber 22 is evacuated partially to allow expansion of bag 20 to its specified fill volume. Fulcrum 23 allows the bag to be accurately weighted, and may provide a partial air seal for applying negative pressure on the walls of bag 20. The fulcrum 23 may also contain RF heating electrodes to apply sealing energy to the bag entrance, and act as a pinching device to effect the opening and closing of the fluid entrance to the bag during filling. Positioning of the bag packaging station below the storage reel allows gravity to assist in partially expanding the bags for filling. Appropriate indexing and bag transfer equipment (not shown) are incorporated into the mechanism of FIG. 6 to allow mechanical and automated unreeling of the bag set and positioning of the bag sets sequentially in the fill station for filling and sealing and subsequent removal of filled bags and insertion of the next bag to be filled.

Figure 7:
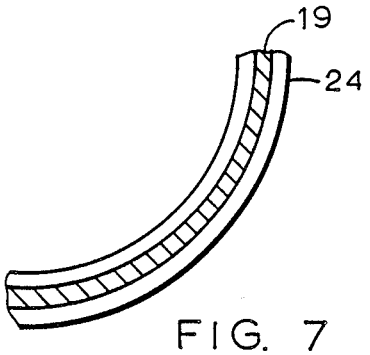
FIG. 7 is an enlarged, cross-sectional view of the bag set of FIG. 6 on a reel.
Figure 8:
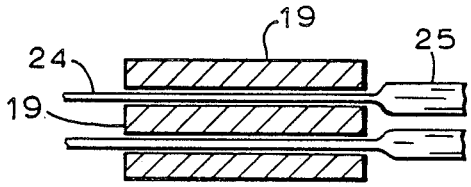
FIG. 8 is another enlarged, cross-sectional view of the bag set of FIG. 6 with a spacer.

FIG. 7 shows a cross section of the bag wrapped on the reel 18 including spacer 19 and bag set edge 24. FIG. 8 shows another cross section of the bag with the spacer inserted and wrapped on reel 18. The spacers 19 separate the bag set leaves 24 created by the spiral wrapping of the bag set on the reel. Areas of the bag set 25 are not covered by spacers and are thus allowed to expand to permit fluid to flow along the length of the bag set from the filling port to the bag being filled.

Figure 9:
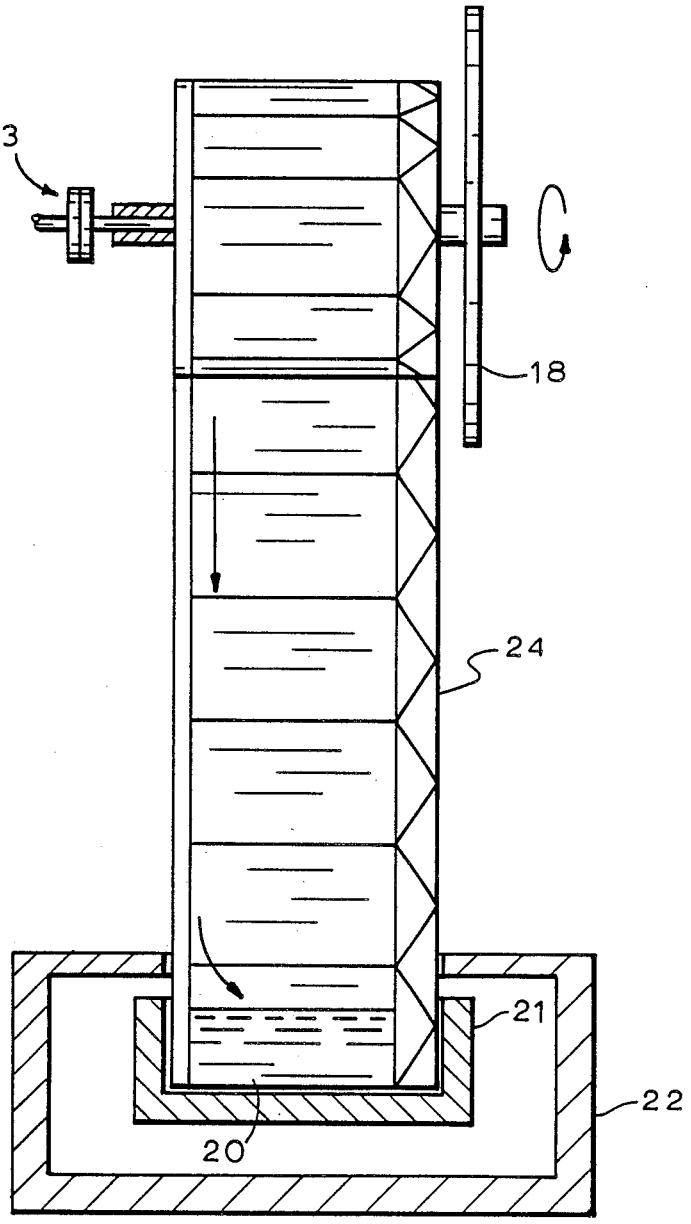
FIG. 9 is an illustrative top plan vie of the packaging apparatus of FIG. 6.

FIG. 9 shows a top view of the reel 18 and the bag set 24 unwinding from the reel to position the bag being filled 20 onto the weigh pan 21 for filling in the vacuum chamber 22. Sterilizing filter 3 is positioned on the center of the reel for fluid entry into the bag set and subsequent filling of bag 20. Sterilizing filter 3 must be held so that the feed line to the filter can effect a rotating seal as the reel 18 is turned to unwind the bag set. Alternatively, sufficient tubing may be supplied so twisting of the feed line does not inhibit fluid flow to the bag set.

In the above configurations, it is possible that the reel could be eliminated through proper packaging of the empty bag set with associated spacers similar to spacer 19 to allow fluid to flow from the entrance of the set, through the set to the portion of the set being formed into bags. One example is where the bag set is stored in an accordion manner in a box. This storage technique would also eliminate need for a rotating seal on the entrance to the bag set.

Figure 10:
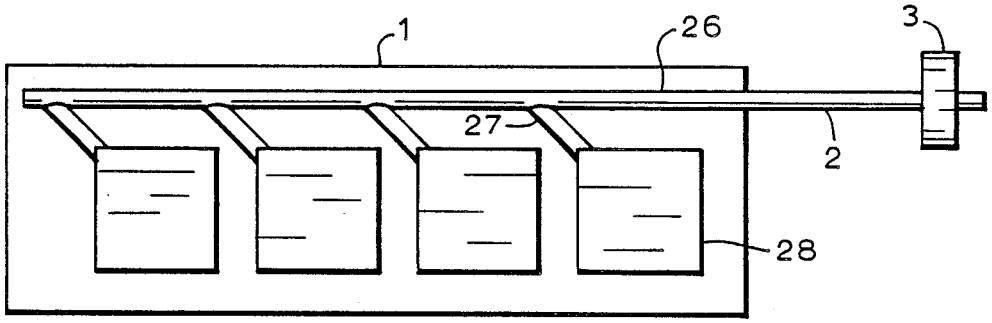
FIG. 10 is an illustrative top plan view of another bag set used in the invention.
Figure 11:
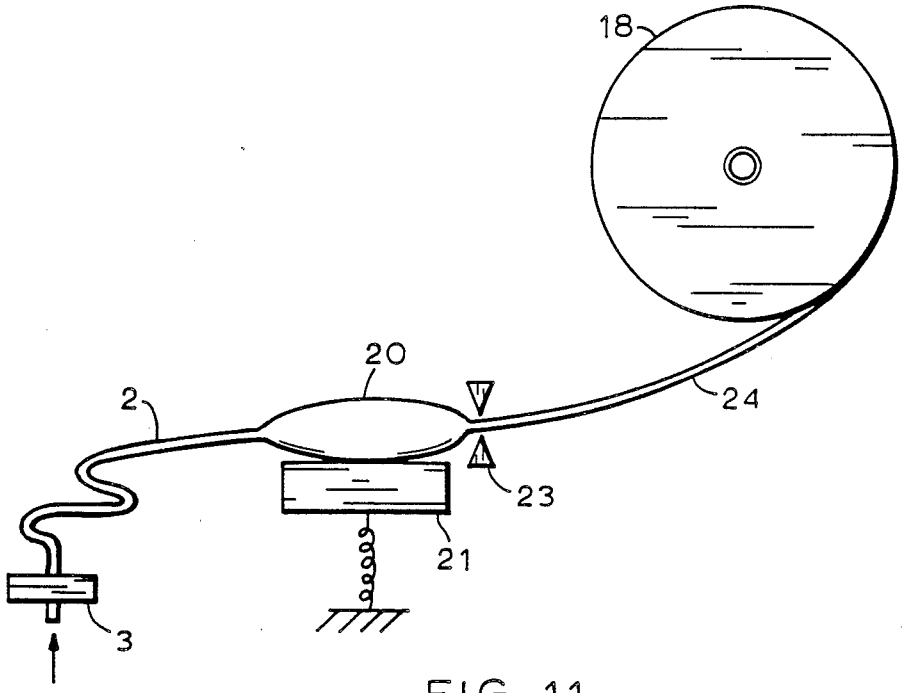
FIG. 11 is a schematic, illustrative side view of a packaging apparatus used to fill the bag sets of FIG. 10.

FIG. 10 shows a variation of the bag set that allows a different type of filling sequence. In this case, the fill tube 2 enters the bag set web proper and continues the length of the bag set. Fluid connections 27 connect the individual bags 28 with the fill tube. This bag configuration allows a different type of filling operation as shown in FIG. 11. Reel 18 holds the empty bag set wrapped on it. The bag set 24 is rolled off the reel and fed onto the scale 21 and through the fulcrum and sealing jaws 23. In this case, the filling tube 2 enters the bag set web from the end where bags are being made. Reel 18 can be replaced by a box holding the bags in a folded and compact manner similar to a box holding a continuous web of computer paper, as no fluid has to flow through the tubes as they are in the packaged position.

Figure 12:
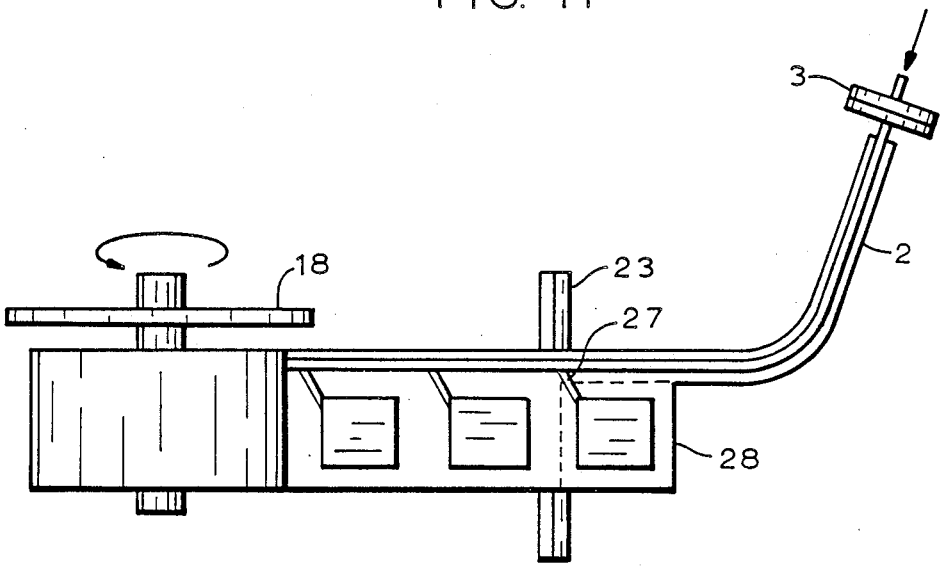
FIG. 12 is an illustrative top plan view of the packaging apparatus of FIG. 11.

FIG. 12 shows a top view of the bag filling system. Reel 18 unrolls the bag set. The bags are sequentially placed across the fulcrum and sealing edge 23 and filled by the fill tube 2. Fluid connection 27 also falls across the jaws of the fulcrum to provide for sealing of the bag when it is filled to the proper volume. Once filled and sealed, bag 28 is cut or torn away from the bag set web to leave the fill tube 2 connecting the next bag to be filled, for the sequence to be repeated. As this operation is repeated, fill tube 2 becomes longer and longer.

The major difference between the filling sequence of FIG. 9 and that of FIG. 12 is that in the former, the bag set is filled from the opposite end from which the bags are being made, and in the latter, the bag set is being filled at the same end the bags are being made. The advantage of both methods is that the bag set can be stored in a compact manner, yet fed into a single fill station which contains all the necessary valving and other equipment to fill, seal and separate the bags. Additionally, the bag set can be made as simple as in FIG. 1, and heat sealing equipment and labeling equipment can be incorporated at the filling station to make individual bags with spike ports and Provision for hanging bags.

The advantage of the method shown in FIG. 9 is that the fill tube and associated passages from the fill port to the bag being filled are protected from kinks and possible physical damage during filling. Also, the removal of the filled bags from the bag filling machine will be easier to automate and easier for the operator to handle. This method could also be used to make, say, 100 bags from one bag set. A disadvantage is the rotating seal or other means that must be incorporated between the fluid generation system and the sterilizing filter to allow the reel to rotate to discharge bags to the bag filling station. With proper packaging, where the bags are stored in a folded manner, but spacers are still inserted to allow fluid through the bags, this disadvantage could be possibly eliminated.

The advantage of the method shown in FIG. 12 is that clearly the rotating seal or other rotating relief means is eliminated from the system. Also, better packing density may be achieved with the empty bag sets, as spacers could be eliminated between bags that were needed to provide for fluid flow through the bag set. A box for example could be used that contained the empty bags in a folded manner. A disadvantage is that the fill tube 2 becomes increasingly longer as the bags are filled, causing increased chances for kinking or physical damage to it during the fill cycle. Also, the bag set will be more expensive to manufacture, calling for more sealing at the factory and possibly increased thickness of bag walls.

What is claimed is:

1. A method of packaging a sterile solution into a plurality of sterile, flexible bags of defined volume in a non-sterile atmosphere, which method comprises:

(a) providing a pre-sterilized bag set composed of a heat-sealable thermoplastic polymer, the bag set comprising a plurality of preformed, unfilled, individual bags of defined volume arranged in a sequentially connected series and adapted to be compactly stored in a unfilled condition, the bag set having a single inlet for the introduction of a sterile solution to be packaged and a single fill tube connected to the single inlet, the inlet tube extending generally the length of the bag set and a plurality of short, individual bag fill tubes extending from the single fill tube to be each of the individual bags of the bag set;

(b) compactly storing the bag set in a storage means;

(c) sequentially withdrawing from the compactly stored bag set, the individual bags;

(d) introducing a sterile solution of a defined volume into the single inlet of the bag set and through the fill tube sequentially into the individual fill tubes of the individual bags as withdrawn from the storage means;

(e) filling a defined volume of the sterile solution from the fill tube and through the individual fill tube into the withdrawn individual bag as withdrawn from the storage means;

(f) sequentially heat sealing the individual bag fill tube after the filling of the sterile solution; and (g) removing from the bag set the individual, filled, sterile, heat-sealed, flexible bags.

2. The method of claim 1 which includes providing a bag set having individual bag fill tubes which extend at an angle from the single fill tube to an adjacent, offset individual bag and heat sealing the individual fill tube of the bag between individually separated bags.

3. The method of claim 1 which includes introducing a sheet of spacer material between the individual bags in the bag set in the compact, stored condition.

4. The method of claim 1, which includes compactly storing the bag set on a reel containing a spiral wound bag set and withdrawing individual bags from the reel as required for filling and sealing.

5. The method of claim 1, wherein the fill tube extends along one longitudinal edge of bag set and the individual fill tubes extend a short distance from the fill tube and at an angle of the fill tube.

6. The method of claim 1, which includes providing a bag set having bag hanging elements onto the individual bags of the bag set.

7. The method of claim 1, which includes providing a bag set having a sterile seal exit port in each individual bag of the bag set.

8. The method of claim 1, which includes filling the sterile solution into the individual bags withdrawn from the bag set to a defined volume by measuring the weight of the sterile solution introduced.

9. The method of claim 1, which includes introducing the withdrawn individual bag into a partial vacuum chamber containing a weighing device and providing for the expansion of the withdrawn individual bag in the vacuum chamber and filling the sterile solution into the expanded bag by weighing the sterile solution filled into the bag to a defined weight.

10. The method of claim 1, which includes introducing the sterile solution through a sterilizing filter into the single inlet of the bag set.

11. The method of claim 1, which includes:

(a) storing the bag set between a layer of an adjacent spacer sheet material in a wound form on a reel;
(b) connecting the single inlet of the bag set to a rotary seal at the center of the reel;
(c) withdrawing sequentially the individual bags by unwinding the bag set from the reel;
(d) placing the withdrawn bag into a weighting pan for filling to the defined volume of sterile solution into the withdrawn individual bags; and
(e) introducing the sterile solution to be packaged into the rotating seal at the center of the reel on which the bag set is wound for filling into the individual bags.

12. The method of claim 1 which includes spirally winding the bag set onto a reel as the compact storage means and introducing the sterile solution into the single inlet of the bag set at the one end of the spirally wound bag set wherein the sequentially withdrawn individual bag is unwound from the reel for filling.

13. The method of claim 1, wherein the bag set comprises a transparent, heat sealable, thermoplastic polymer.

14. The method of claim 1, wherein the individual fill tubes extend at an angle from the single fill tube into the top on the individual bags and heat sealing the individual fill tube and between the individual bags in the bag set to permit removal of the individual heat sealed, filled bags from the bag set.

15. The heat sealed, removed, sterile filled, individual bags prepared in the method of claim 14.

16. A pre-sterilized bag set for use in a method of filling individual bags of the bag set with a defined volume of sterile solution, the pre-sterilized bag set composed of a heat sealable thermoplastic polymer, the bag set comprising a plurality of sequential, aligned, preformed, unfilled, separated, individual bags of defined volume, the bag set having a single inlet at the one end of the bag set for the introduction of a sterile solution to be packaged and a single fill tube connected to the inlet, the single fill tube extending along generally the entire length of the bag set, and a plurality of short, individual bag fill tubes extending from the single fill tube into each of the individual bags of the bag set.

17. The bag set of claim 16, which includes a sterilizing filter means comprising a microporous membrane filter with a pore size of not larger than about 0.45 micrometers secured to the single inlet of the bag set.

18. The bag set of claim 16, which comprises a transparent, heat sealable, thermoplastic vinyl polymer.

19. The bag set of claim 16, wherein the single fill tube extends longitudinally along the substantial entire length of one edge of the bag set.

20. The bag set of claim 16, wherein the individual fill tube extends a short distance and at an angle to the single fill tube.

21. The bag set of claim 20, wherein the angled individual fill tube extends opposite one individual bag of the bag set to the adjacent individual bag set the heat sealing of the angled individual fill tube may also heat seal between the individual adjacent bags of the bag set.

* * * * *